US007817096B2

(12) United States Patent
Linehan

(10) Patent No.: US 7,817,096 B2
(45) **Date of Patent: *Oct. 19, 2010**

(54) CELLULAR ANTENNA AND SYSTEMS AND METHODS THEREFOR

(75) Inventor: Kevin Eldon Linehan, Rowlett, TX (US)

(73) Assignee: Andrew LLC, Hickory, NC (US)

( * ) Notice: Subject to any disclaimer, the term of this patent is extended or adjusted under 35 U.S.C. 154(b) by 706 days.

This patent is subject to a terminal disclaimer.

(21) Appl. No.: 11/505,548

(22) Filed: Aug. 17, 2006

(65) Prior Publication Data

US 2007/0030208 A1 Feb. 8, 2007

Related U.S. Application Data

(63) Continuation-in-part of application No. 11/399,627, filed on Apr. 6, 2006, now Pat. No. 7,639,196, which is a continuation-in-part of application No. 10/312,979, filed on Jun. 16, 2003.

(51) Int. Cl.
*H01Q 3/00* (2006.01)

(52) U.S. Cl. ..... 343/757

(58) Field of Classification Search ..... 343/757, 343/763–766, 702, 700 MS
See application file for complete search history.

(56) References Cited

U.S. PATENT DOCUMENTS

| | | | | |
|---|---|---|---|---|
| 4,197,548 | A * | 4/1980 | Smith et al. | 343/765 |
| 4,336,540 | A * | 6/1982 | Goodwin et al. | 342/157 |
| 5,751,247 | A * | 5/1998 | Nomoto et al. | 342/359 |
| 5,969,685 | A * | 10/1999 | Hayes et al. | 343/702 |
| 6,208,299 | B1 * | 3/2001 | Lindmark et al. | 343/700 MS |
| 6,421,021 | B1 * | 7/2002 | Rupp et al. | 343/753 |
| 6,747,604 | B2 * | 6/2004 | Amyotte et al. | 343/754 |
| 6,795,020 | B2 * | 9/2004 | Sreenivas et al. | 343/700 MS |
| 6,879,295 | B2 * | 4/2005 | Taylor | 343/757 |
| 6,963,314 | B2 * | 11/2005 | Webb et al. | 343/844 |
| 2004/0209572 | A1 * | 10/2004 | Thomas | 455/63.4 |

* cited by examiner

*Primary Examiner*—Huedung Mancuso
(74) *Attorney, Agent, or Firm*—Husch Blackwell Welsch Katz LLP

(57) ABSTRACT

Multi-array antennas providing dual electrical azimuth beam steering, combined mechanical and electrical azimuth steering, independent mechanical column steering and dual mechanical steering. Systems incorporating such antennas and methods of controlling them are also provided.

37 Claims, 15 Drawing Sheets

CELLULAR ANTENNA AND SYSTEMS AND METHODS THEREFOR

CROSS REFERENCE TO RELATED APPLICATIONS

This application is a continuation-in-part of, and claims the benefit of priority from application Ser. No. 11/399,627, filed 6 Apr. 2006, entitled A CELLULAR ANTENNA AND SYSTEMS AND METHODS THEREFOR (referred to herein as "Elliot"), and currently pending, which is a continuation-in-part of and claims the benefit of priority from application Ser. No. 10/312,979, filed Jun. 16, 2003, entitled Cellular Antenna (referred to herein as "Rhodes"), and currently pending.

FIELD OF THE INVENTION

This invention relates to a cellular antenna and systems incorporating the antenna as well as to methods of controlling the antenna. More particularly, although not exclusively, there is disclosed a multi-array allowing independent beam steering of each array.

BACKGROUND OF THE INVENTION

The applicant's prior application US2004/0038714A1 ("Rhodes"), the disclosure of which is incorporated by reference, discloses an antenna system providing remote electrical beam adjustment for down tilt, beam width and azimuth.

Systems for effecting mechanical adjustment of antenna beam azimuth are known but have not been well integrated into a cellular antenna. Whilst Rhodes discloses integrated antenna systems providing electrical attribute adjustment (e.g. down tilt, azimuth and beam width) there is a need for independently controlling attributes of multi-array antennas.

EXEMPLARY EMBODIMENTS

There is provided an antenna allowing electrical and/or mechanical beam steering to provide independent steering of the beams of an integrated multi-array antenna. An integrated control arrangement is provided which can utilise either serial, wireless or RF feed lines to convey communications. Systems incorporating such antennas and methods of controlling them are also provided. A number of embodiments are described and the following embodiments are to be read as non-limiting exemplary embodiments only.

According to one exemplary embodiment there is provided a cellular antenna comprising:

a. a first array of radiating elements configured to develop, when excited, a first beam;
b. a first feed network associated with the first array having one or more first controllable elements for adjusting the azimuth direction of the first beam;
c. a second array of radiating elements configured to develop, when excited, a second beam;
d. a second feed network associated with the second array having one or more second controllable elements for adjusting the azimuth direction of the second beam, wherein the first controllable elements may be controlled independently of the second controllable elements to allow independent azimuth steering of the first and second beams of the arrays; and
e. an antenna housing accommodating the first and second arrays.

According to another exemplary embodiment there is provided a method of azimuth steering the beams of an integrated cellular antenna having a first array of radiating elements arranged in multiple columns and a second array of radiating elements arranged in multiple columns wherein columns of the first array are fed with phase shifted signals such that the azimuth direction of the beam of the first array is oriented in a first direction and wherein columns of the second array are fed with phase shifted signals such that the azimuth direction of the beam of the second array is oriented in a second direction, different to the first direction.

According to another exemplary embodiment there is provided a cellular antenna comprising:

a. an array antenna having first and second arrays of radiating elements configured to develop, when excited, first and second beams respectively, the array antenna being rotatably mountable with respect to an antenna support so as to enable mechanical azimuth steering of the first and second beams;
b. a mechanical azimuth actuator configured to rotate the array antenna with respect to an antenna support;
c. a first feed network configured to supply signals to and receive signals from the first array of radiating elements including a first variable element to vary the phase of signals passing through the feed network;
d. a first variable element adjuster configured to adjust the first phase shifter; and
e. an actuator controller configured to receive control data and to control the mechanical azimuth actuator in accordance with mechanical azimuth control data received to rotate the array antenna with respect to an antenna support to alter the orientation of the antenna and to control the first variable element adjuster in accordance with electrical azimuth control data received to adjust the azimuth beam direction of the first array with respect to the azimuth beam direction of the second array.

According to another exemplary embodiment there is provided a method of adjusting beam azimuth for a multi-array antenna having first and second arrays of radiating elements configured to develop, when excited, first and second beams respectively wherein the first array has a feed network including one or more variable elements for adjusting first beam azimuth, the method comprising:

a. mechanically orienting the antenna so as to achieve a desired azimuth beam direction for the second beam; and
b. setting the one or more variable elements so as to achieve a desired beam azimuth for the first beam, different to the beam azimuth for the second beam.

According to another exemplary embodiment there is provided a method of setting different beam azimuth orientations for first and second beams of a multi-array antenna having first and second arrays of radiating elements in which the first array has a first feed network including one or more variable elements for adjusting beam azimuth and the second array has a second feed network including one or more variable elements for adjusting beam azimuth, the method comprising:

a. mechanically orienting the antenna so as to orient a line normal to the antenna between desired beam directions for the first and second beams;
b. setting the one or more variable elements of the first feed network so as to achieve a desired beam azimuth for the first beam; and
c. setting the one or more variable elements of the second feed network so as to achieve a desired beam azimuth for the second beam.

According to another exemplary embodiment there is provided a cellular antenna comprising an antenna housing; a plurality of panels of radiating elements relatively rotatable with respect to the antenna housing and azimuth actuators for independently rotating each panel with respect to the antenna housing.

According to another exemplary embodiment there is provided a method of steering the beam of an antenna comprising a plurality of panels of radiating elements relatively rotatable with respect to an antenna housing having azimuth actuators for independently rotating each panel with respect to the antenna housing, the method comprising rotating selected panels with respect to the antenna housing to achieve a desired beam pattern and or orientation.

According to another exemplary embodiment there is provided a cellular antenna comprising:

a. a central panel having a first array of radiating elements;
b. a pair of outer panels of radiating elements rotatably connected to edges of the central panels; and
c. an actuator arrangement for adjusting the relative positions of the outer panels with respect to the central panel.

According to another exemplary embodiment there is provided a method of adjusting beam azimuth for a multi-array antenna having first and second arrays of radiating elements configured to develop, when excited, first and second beams respectively, the method comprising:

a. orienting the first beam to achieve a desired azimuth beam direction for the first beam; and
b. orienting the second beam to achieve a desired azimuth beam direction for the second beam, different to the beam azimuth for the first beam.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

FIGS. 3*g* to 3*l* show various configurations of the antennas shown in FIG. 3*f;*

DESCRIPTION OF EMBODIMENTS OF THE INVENTION

Attributes of an antenna beam may be adjusted by physically orienting an antenna or by adjusting the variable elements of an antenna feed network. Physically adjusting the orientation of an antenna mechanically maintains a better radiation pattern for the antenna beam than by adjusting a variable element in the feed network. For down tilt a better radiation pattern is obtained by adjusting a variable element in the feed network than by mechanically orienting the antenna.

Figure 1:
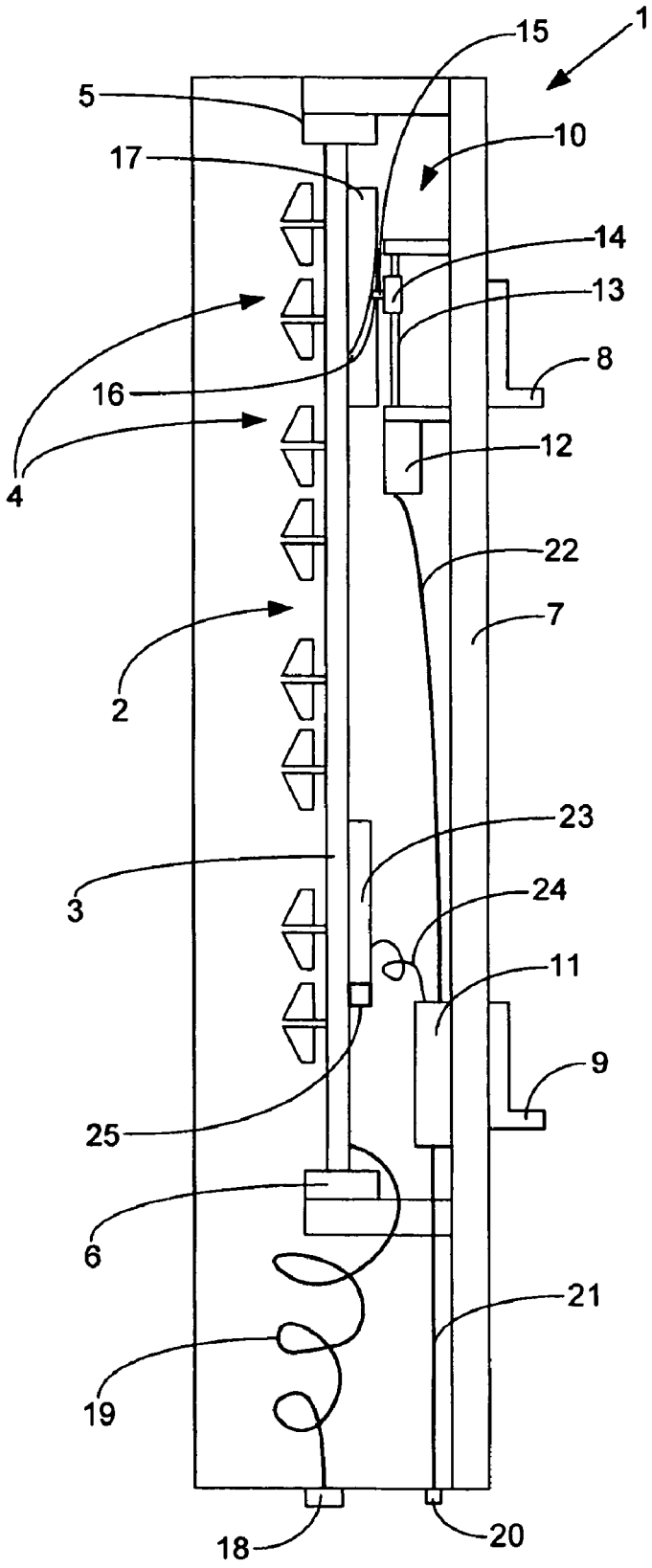
FIG. 1 shows a schematic side view of an antenna according to a first embodiment.

FIG. 1 shows a side view of a cellular antenna 1 according to a first embodiment. Antenna 1 includes an array antenna 2 having a reflector 3 and a plurality of radiating elements 4 (only some of which are indicated and the number of which may vary). Reflector 3 is rotatable about bearings 5 and 6 so that the array antenna 2 can rotate with respect to antenna support 7. Mounting brackets 8 and 9 allow the antenna to be mounted to a support structure such as a tower.

An azimuth position actuator 10 rotates array antenna 2 with respect to antenna support 7 in response to drive signals from actuator controller 11. Azimuth position actuator 10 may be in the form of a geared motor 12 driving a threaded shaft 13 which drives a nut 14 up and down as it rotates. Nut 14 has a pin 15 projecting therefrom which locates within a helical groove 16 in semi cylindrical guide 17. As pin 15 moves up and down guide 17 causes the array antenna 2 to rotate about its vertical axis to provide mechanical azimuth steering. It will be appreciated that a range of mechanical drive arrangements could be employed, such as geared drive trains, crank arrangements, belt and pulley drives etc.

In the embodiment shown in FIG. 1 an RF feed is supplied to connector 18 and a coiled feed line 19 supplies the RF feed to antenna array 2. In this embodiment control signals are provided to serial bus connector 20 and supplied to controller 11 via cable 21. Actuator controller 11 controls azimuth position actuator motor 12 via cable 22 and controls one or more actuator adjusting one or more variable element contained within variable feed assembly 23 via cable 24. Both cables 19 and 24 have excess length to enable ease of rotation of antenna array 2.

Variable feed assembly 23 may include a single phase shifter or multiple phase shifters to adjust down tilt. Variable feed assembly 23 may additionally or alternatively include one or more phase shifter or power divider to effect beam width adjustment. Variable feed assembly 23 may also include one or more phase shifter to effect electrical azimuth adjustment. Electrical azimuth adjustment may be provided for a multi-array antenna so that the azimuth of the antenna beam of a first array may be adjusted mechanically and the antenna beam of a second array may be adjusted electrically to achieve a desired offset.

Actuator controller 11 may receive status and configuration information from variable feed assembly 23 such as the current position of phase shifters or power dividers or whether an actuator has a fault condition etc. A compass 25 may also be provided to give a real-time measurement as to the azimuth orientation of antenna array 2. The basic reading may be adjusted with respect to true North at the place of installation. This status and configuration information may be supplied from actuator controller 11 to a base station auxiliary equipment controller via a serial cable connected to connector 20.

In use serial data received by actuator controller 11 will include an address for an actuator controller along with data specifying desired operating parameters. When actuator controller 11 receives data associated with its address it controls actuators in accordance with control data for an attribute to be controlled. For example, actuator controller 11 may receive data for mechanical azimuth with a value of 222 degrees. Controller 11 obtains orientation information from compass 25 and drives motor 12 so as to rotate antenna 2 until the compass reading from compass 25 corresponds with the desired orientation. Likewise, controller 11 may receive data for a required down tilt angle. A down tilt phase shifter actuator, such as a geared motor, may drive one or more phase shifter in the feed network until an associated position sensor communicates to actuator controller 11 that the desired phase shifter position has been achieved (see U.S. Pat. No. 6,198,458, the disclosure of which is incorporated by reference). Likewise, beam width actuators and azimuth actuators may be driven by actuator controller 11 to achieve desired values.

In this way actuator controller 11 can control mechanical azimuth and electrical azimuth, down tilt and beam width in response to commands received from a addressable serial bus.

Figure 2A:
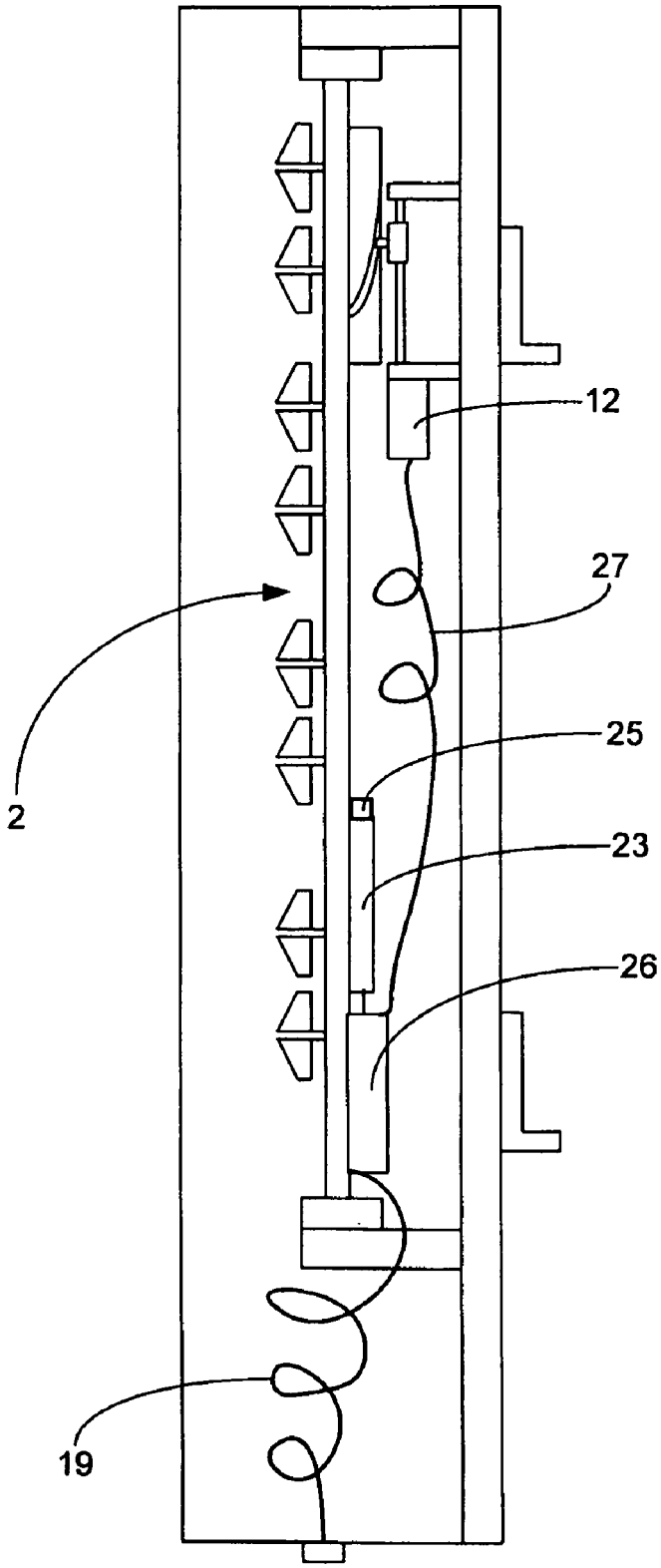
FIG. 2*a* shows a schematic side view of an antenna according to a second embodiment.

FIG. 2*a* shows a second embodiment in which all RF signals and control data are received over a single RF feed line. Like integers had been given like numbers to those shown in FIG. 1. In this embodiment RF feed line 19 supplies RF feed signals to antenna interface 26 which supplies RF signals to variable feed assembly 23 and extracts and supplies control data to actuator controller 23. As antenna interface 26 is mounted to reflector 3 a flexible control cable 27 is provided to azimuth motor 12. Antenna interface 26 may extract power supplied by an RF feed line to operate actuator controller 23 and it associated actuators. A DC bias voltage may be applied to the RF feed line at the base of a cellular base station tower and extracted by antenna interface 26 at the top of the tower. This arrangement has the advantage that only a single RF feed line need be connected to each antenna to provide both RF signals and control data.

Figure 2B:
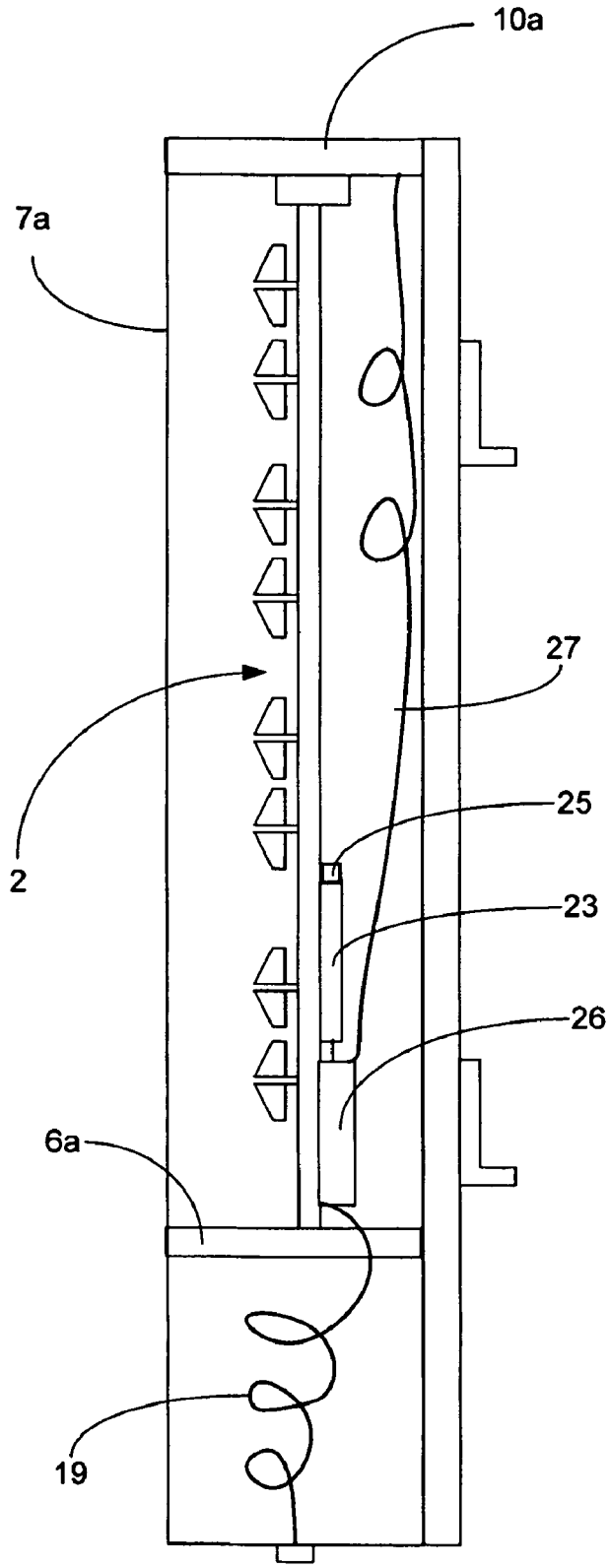
FIG. 2*b* shows a schematic side view of an antenna according to a third embodiment.

FIG. 2*b* shows a variant of the embodiment shown in FIG. 1 where the azimuth position actuator 10*a* is in the form of a top mounted geared motor which supports antenna 2 and rotates it. The base of the antenna is maintained in position by bearing 6*a* secured to the base of the antenna and extending to the walls of the radome 7*a*.

Figure 3A:
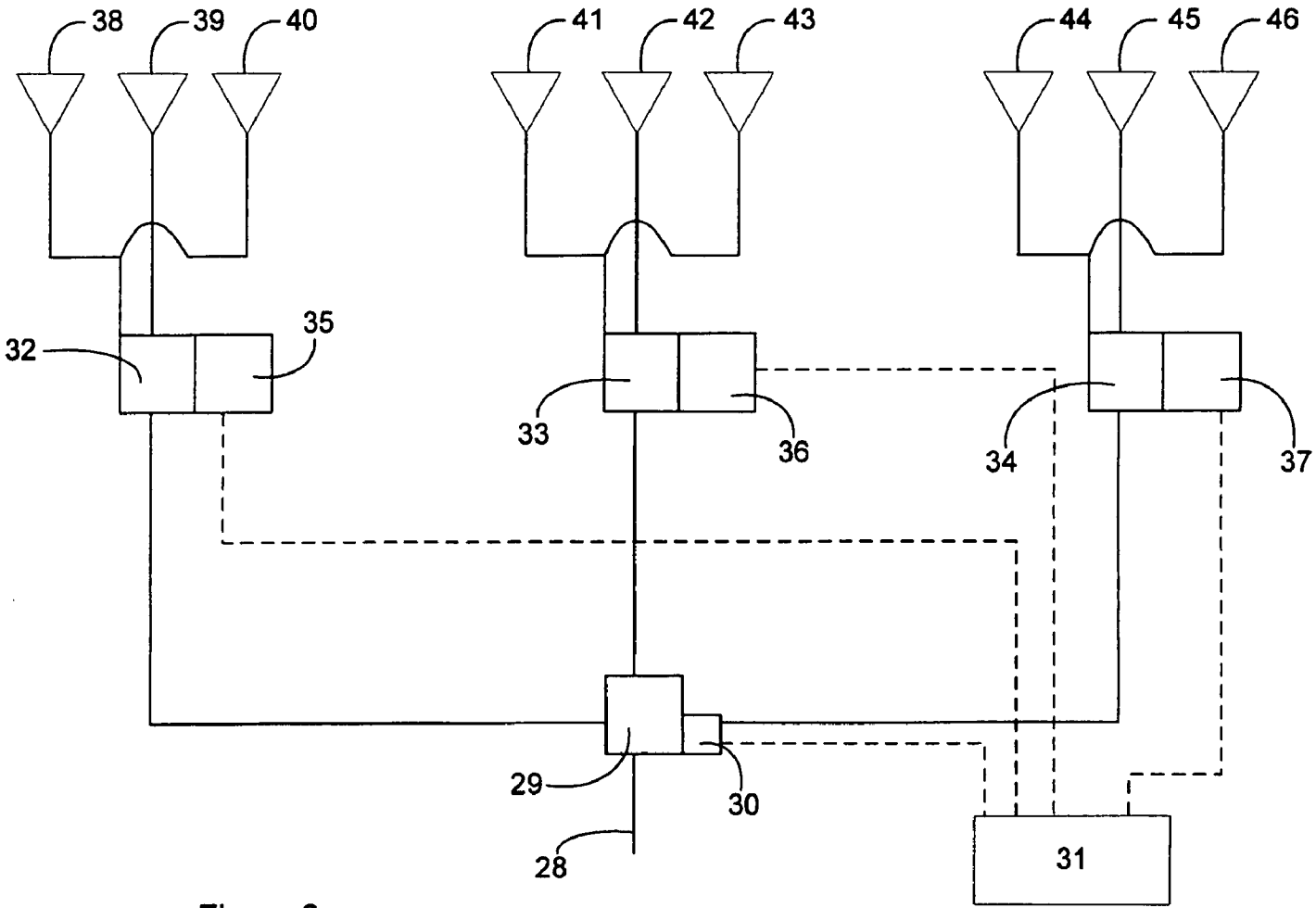
FIG. 3*a* shows a schematic view of a feed arrangement for an antenna of the type shown in FIGS. 1 and 2.

Referring now to FIG. 3*a* there is shown a feed arrangement suitable for adjusting the down tilt and the beam width of the beam of an antenna of the type shown in FIGS. 1 and 2. In this case the antenna includes three rows 38 to 40, 41 to 43 and 44 to 46 of radiating elements although it will be appreciated that any desired number may be employed. RF feed line 28 feeds variable element 29 which in this example is a variable differential phase shifter. Actuator 30 is driven by actuator controller 31 to adjust the position of the variable differential phase shifter 29 to achieve a desired beam down tilt. Actuators 35 to 37 are driven by controller 31 to adjust power dividers 32 to 34 to adjust antenna beam width.

Figure 14:
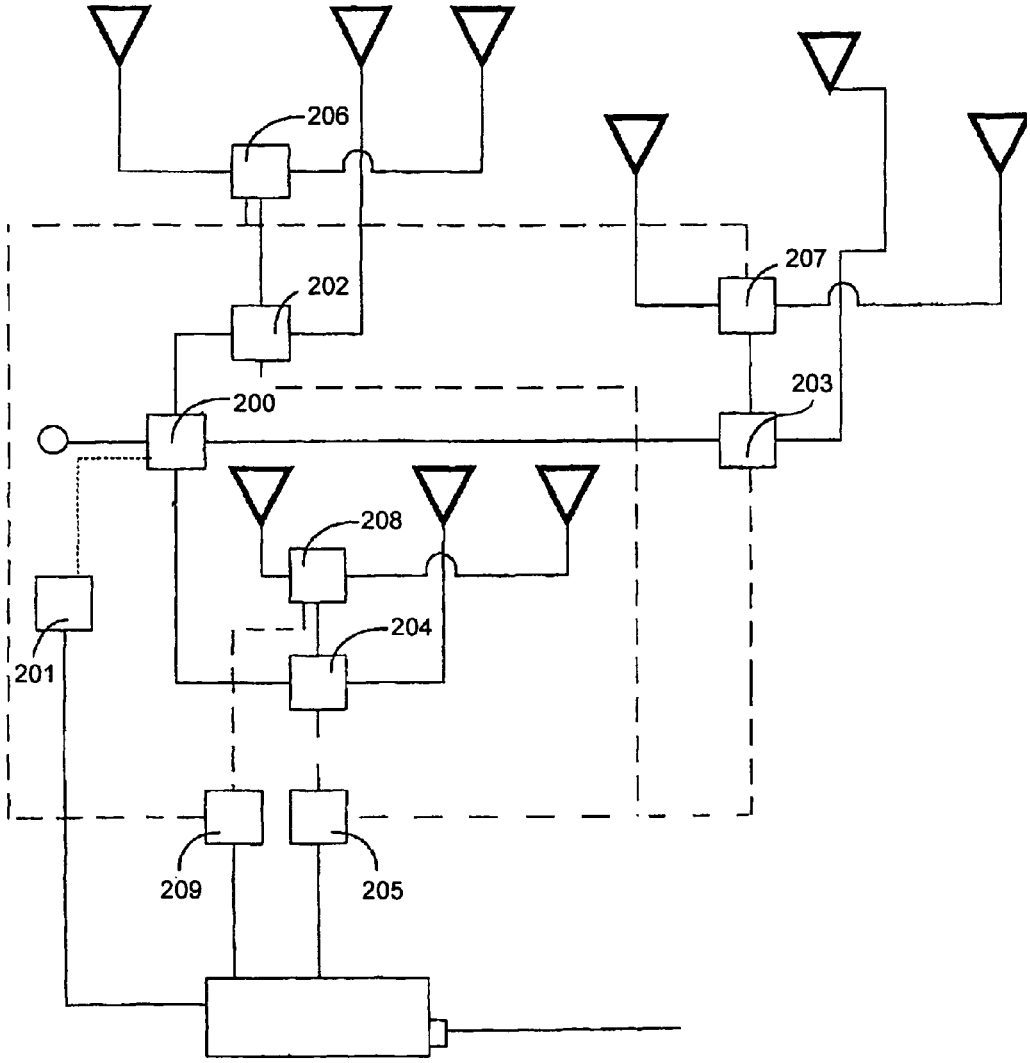
FIG. 14 shows a schematic view of a feed arrangement providing down tilt, azimuth and beam width adjustment.

A number of feed arrangements utilising a range of different possible variable elements may be employed, some examples of which are set out in US2004/0038714A1 which is incorporated herein by reference. Whilst passive variable elements such as differential phase shifters are shown it will be appreciated that the variable elements could be active elements using PIN diodes, optically controlled devices etc. FIG. 14 shows an embodiment including a down tilt phase shifter 200 driven by a down tilt phase shifter actuator 201, power dividers 202, 203 and 204 driven by power divider actuator 205 and azimuth phase shifters 206, 207 and 208 driven by azimuth phase shifter actuator 209 to effect down tilt, beam width and azimuth adjustment of the antenna beam. It will be appreciated that any one or combination of attributes may be adjusted depending upon the application. In a simple application electrical down tilt adjustment may be provided with mechanical azimuth adjustment.

Figure 3B:
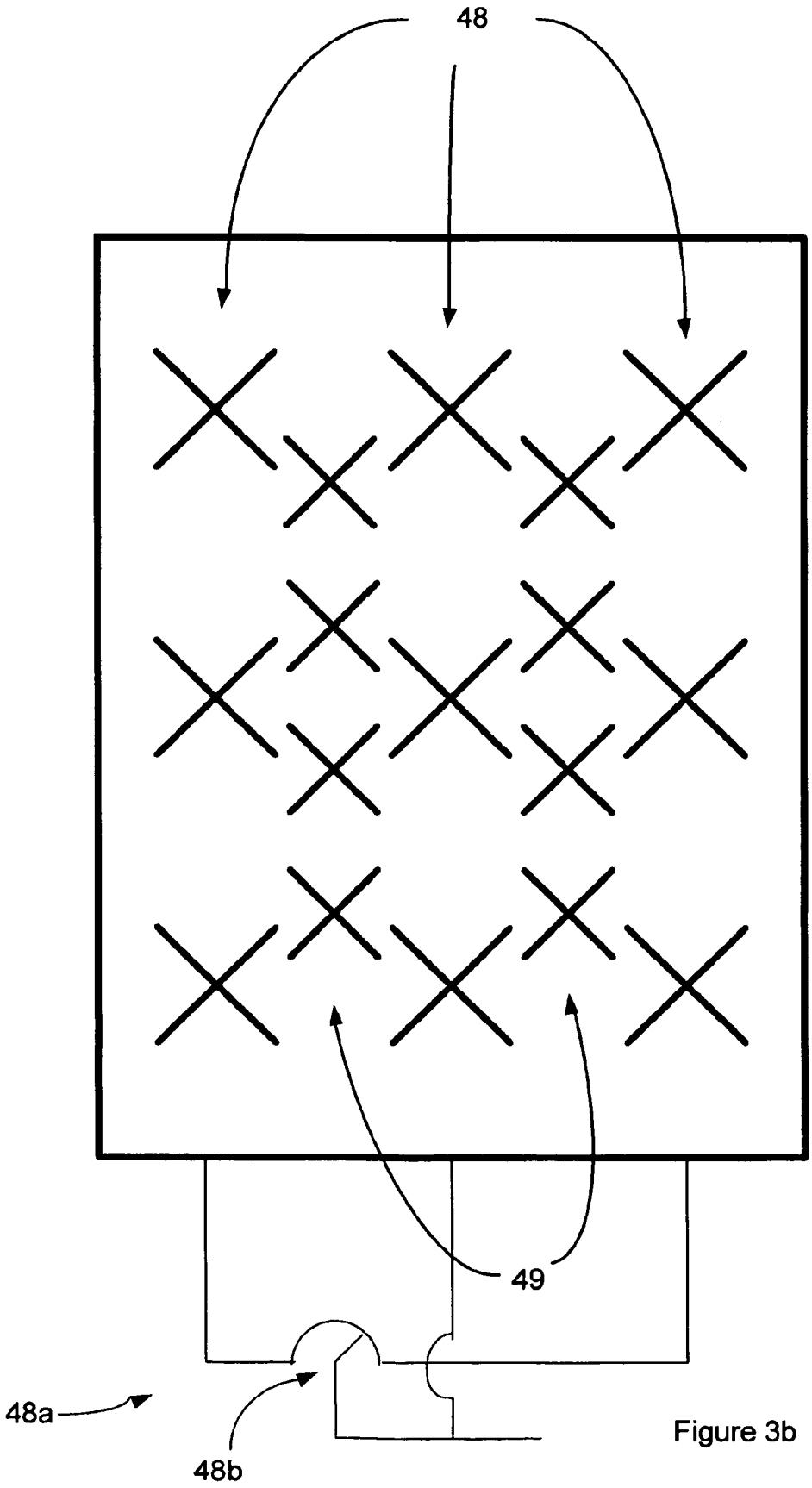
FIG. 3*b* shows a schematic view of a multi-array antenna embodiment.

In the multi-array embodiment shown in FIG. 3*b* a first array of columns of radiating elements 49 may have a feed network as shown in FIG. 3*a* whilst the second array of columns of radiating elements 48 may have a feed network 48*a* including phase shifter 48*b* to vary the phase supplied to the outer columns of radiating elements to effect azimuth beam steering. In this way the beam direction for the first array may be set mechanically by mechanically orienting the antenna and the beam direction for the second array may be offset using electrical azimuth adjustment in the feed network. The arrays may operate in the same or different frequency bands. In the embodiment shown in FIG. 3*b* array 49 operates in a higher band than array 48.

Figure 3C:
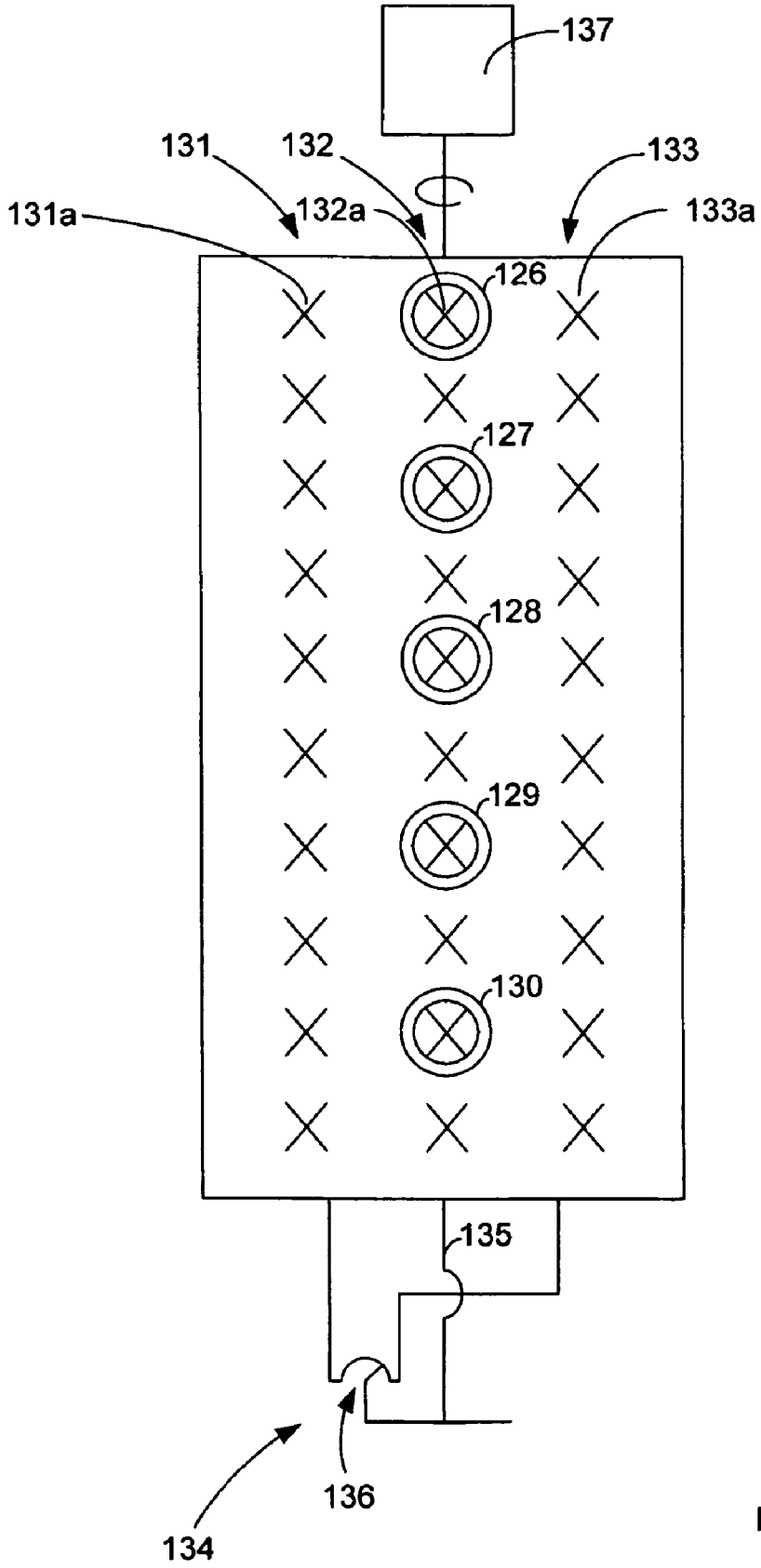
FIG. 3*c* shows a multi-array antenna consisting of a single column low band array and a multi-column high band array.

FIG. 3*c* shows a multi-array antenna having an array of low-frequency band radiating elements which may, for example, take the form of ring radiators 126, 127, 128, 129 and 130 and an array consisting of three columns 131, 132 and 133 of high frequency band radiating elements which may, for example, take the form of cross dipoles 131*a*, 132*a* and 133*a*. It will be appreciated that the radiating elements may be of any suitable form depending upon the application. Feed network 134 consists of a through line 135 feeding central column 132 and variable phase shifter 136 feeding columns 131 and 133. A mechanical azimuth actuator shown schematically as 137 rotates antenna 125 about its vertical axis to provide mechanical azimuth steering. In use the azimuth direction of the beam of low band elements 126 to 130 may be set by driving mechanical azimuth actuator 137 to orient antenna 125 in the desired orientation. Variable differential phase shifter 136 may then be adjusted to orient the azimuth direction of the beam of the high band elements. A local controller may control mechanical azimuth actuator 137 and an actuator to control variable differential phase shifter 136. This may be based on a local control arrangement or in response to control commands from a central controller.

Figure 3D:
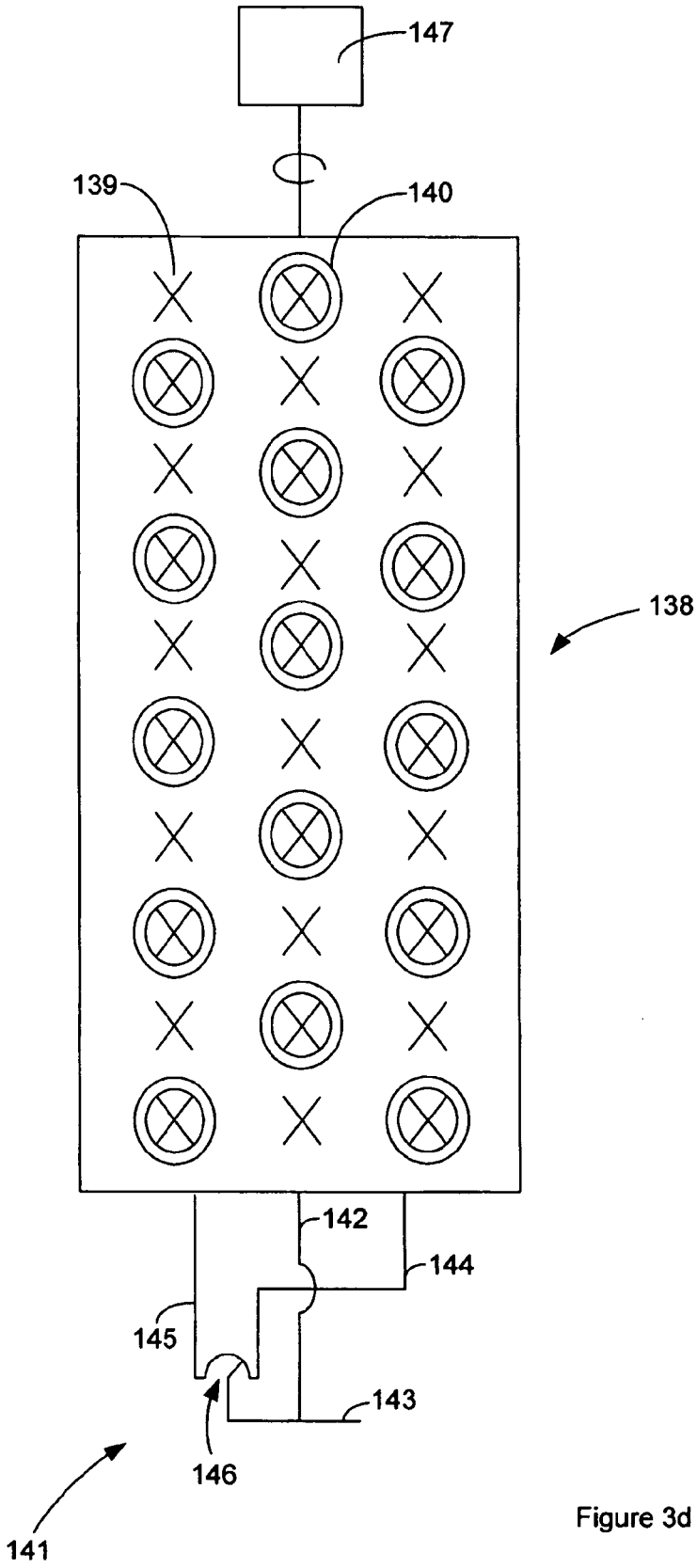
FIG. 3*d* shows a multi-array antenna consisting of a multi-column low band array and a multi-column high band array.

FIG. 3*d* shows a multi-array antenna 138 consisting of an array of high band elements in the form of three columns of cross dipoles (one of which is indicated at 139) and an array of low band elements in the form of three columns of ring radiators (one of which is indicated at 140) which may be staggered and interleaved as shown. In one embodiment one feed network 141 may be provided to feed the columns of the high band radiating elements so that the central column of high band elements is fed by line 142 directly from RF feed line 143 and the outer columns of high band elements are fed by lines 144 and 145 from the outputs of phase shifter 146 which may be any of a variety of electromechanical or electrical configurations. The RF feed and control arrangement could be any of a variety of configurations, including those depicted in FIGS. 5-12 of this specification. Mechanical azimuth actuator 147 allows mechanical azimuth beam steering of antenna 138. This embodiment may operate in the same manner as the embodiment described in FIG. 3*c*. However, if the low band columns are fed in the same manner as the high band columns (i.e. using a feed network as per feed network 141) then the beams of both the high band and low band arrays may be individually electronically steered. Thus mechanical azimuth actuator 147 may be adjusted to orient antenna 138 in a first orientation and the independent high band and low band feed networks may be used to electronically steer the azimuth beam directions for each array. This allows the antenna to be mechanically oriented to position between the desired beam orientation for each array and for the beam of each array to the offset by electronic beam steering to achieve the designed beam orientations. This may minimize distortion of beam patterns by reducing the amount of electrical azimuth beam steering required. By providing the ability to adjust the orientation of the entire antenna 138 and thus both the high and low band arrays together, and in addition adjustment of the high and low band arrays separately, an infinitude of azimuthal settings of the two beams can be achieved to satisfy traffic and other design parameters. In one exemplary embodiment the high frequency band radiating elements may be in the range of 1710 to 1720 GHz and the low frequency band radiating elements may be in the range of 824 to 960 GHz.

Figure 3E:
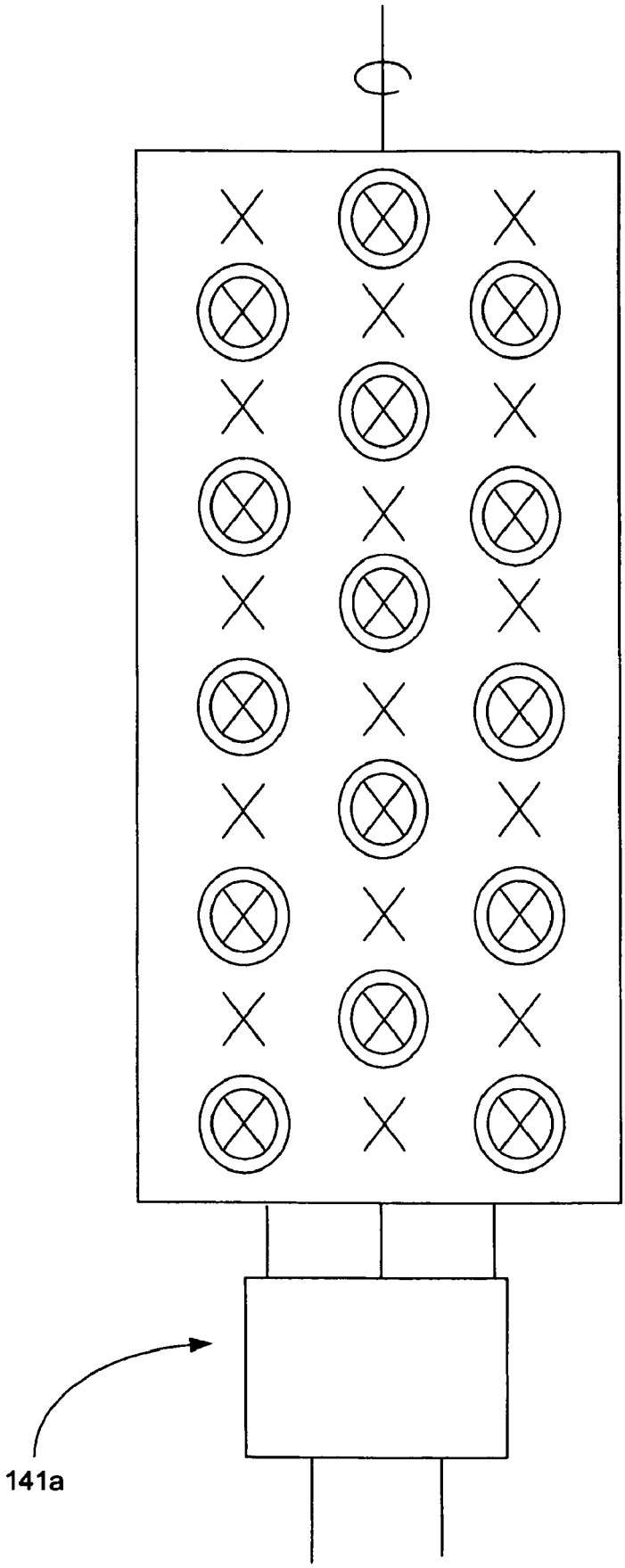
FIG. 3*e* shows a multi-array antenna consisting of a multi-column low band array and a multi-column high band array including an electrical or optical phase shifting feed network.

FIG. 3*e* shows a variant of FIG. 3*d* in which feed network 141 is replaced by feed network 141*a* in which active elements are employed to achieve the desired phase shift for the radiating elements of each column. The active elements may be PIN diodes, optically controlled elements or any other suitable active element.

Figure 3F:
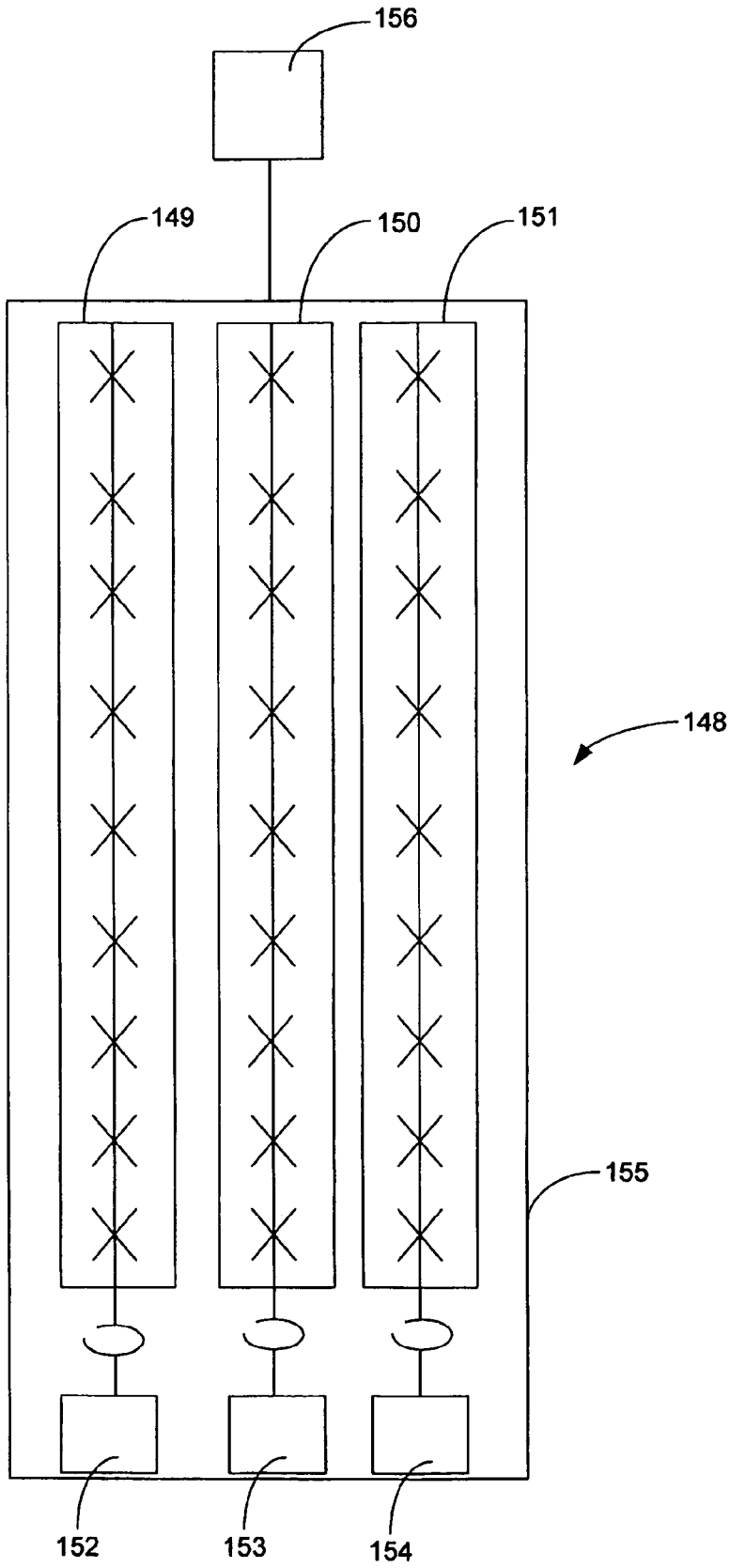
FIG. 3*f* shows an antenna consisting of a number of rotatable panels.
Figure 3G:
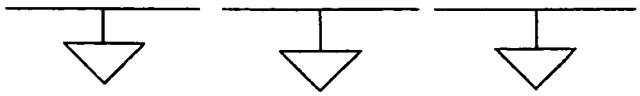
Figure 3H:
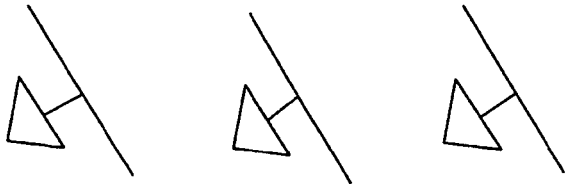
Figure 3J:
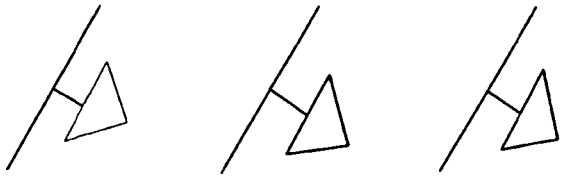
Figure 3K:
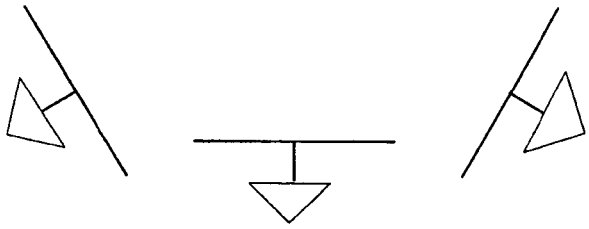
Figure 3L:
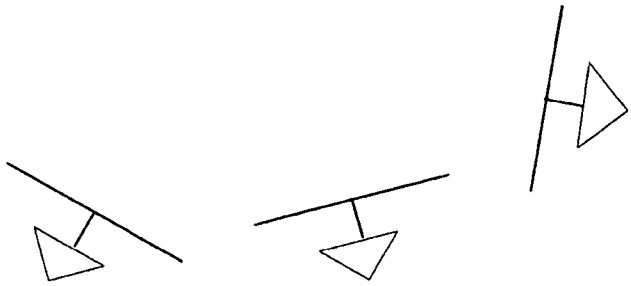

FIG. 3*f* shows an antenna 148 having panels of radiating elements rotatable via actuators 152 to 154 with respect to antenna housing 155. The arrays may be single as shown schematically, or multiple column arrays. This arrangement enables each array of each panel 149 to 151 to be independently oriented with respect to antenna housing 155. Further, housing 155 may itself be rotationally oriented via actuator 156. FIGS. 3*g* to 3*l* illustrate possible configurations of antenna 148. In FIG. 3*g* all panels are oriented flat with respect to antenna housing 155. In FIG. 3*h* all panels are rotated by the same amount to the left and in FIG. 3*j* all panels are rotated by the same amount to the right. In FIG. 3*k* the outer panels 149 and 151 are rotated outwardly to broaden the beam of the antenna. In FIG. 3*l* the configuration of FIG. 3*k* is rotated due to actuator 156 rotating antenna housing 155. Thus the antenna provides azimuth steering and beam shaping by rotation of multiple antenna radiator panels.

Figure 3M:
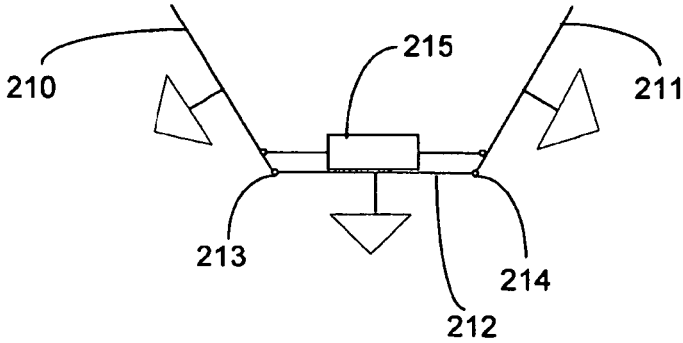
FIG. 3*m* shows an antenna having hinged outer panels.

FIG. 3*m* shows a variant in which outer panels of radiating elements 210 and 211 are pivotable about joints 213 and 214 to central panel of radiating elements 212. Outer panels 210 and 211 may be independently rotated with respect to central panel 212 by individual mechanical actuators or both may be adjusted via a common mechanical linkage 215. This arrangement allows a wide beam width to be generated using a relatively simple antenna structure.

It will be appreciated that in the above embodiments that different forms of radiating elements may be employed. It will also be appreciated that in each of the above embodiments control may be effected by a local controller or a central controller. Each antenna may provide information as to the configuration and orientation of each antenna and control the antenna locally according to a local control strategy or centrally based on a global control strategy.

Figure 4:
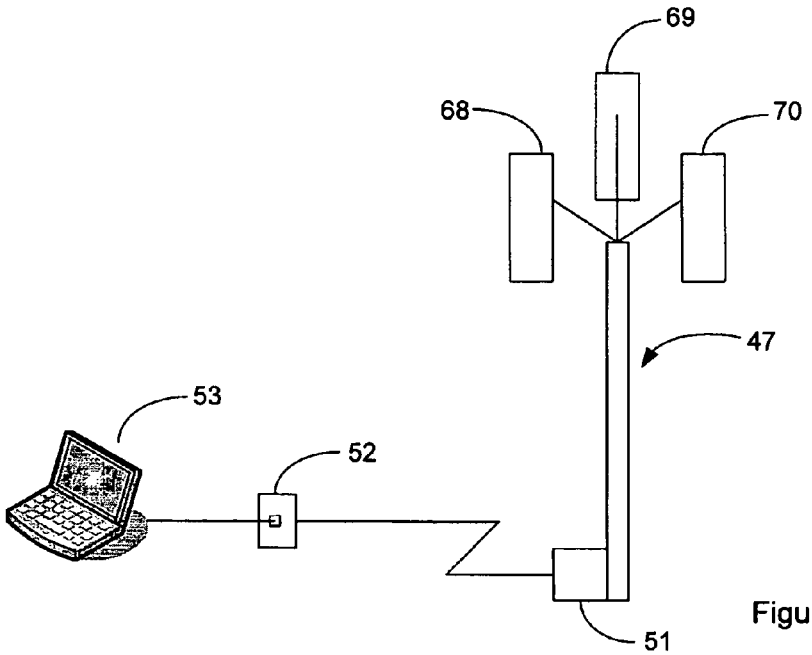
FIG. 4 shows a schematic diagram of a cellular base station in which control data is sent via one or more RF feed line.

Referring now to FIG. 4 a schematic diagram of an antenna base station 47 having three antennas 68, 69 and 70 is shown. Auxiliary equipment controller 51 includes a connector 52 allowing a laptop 53 to interface with base station auxiliary equipment controller 51.

Figure 5:
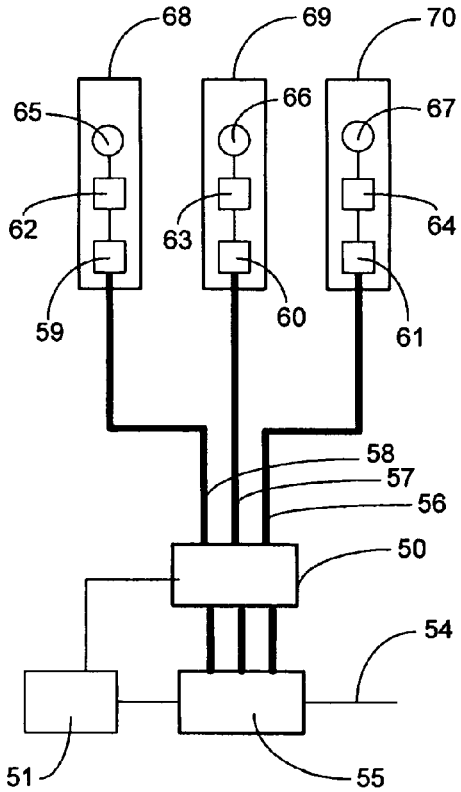
FIG. 5 shows a schematic diagram of a first data communications arrangement for the cellular base station shown in FIG. 4.

FIG. 5 shows a first embodiment in which a base station controller 55 communicates with a central controller via a backhaul link 54. Commands for controlling antenna attributes are sent from base station controller 55 to auxiliary equipment controller 51. A modulation/demodulation arrangement conveys commands between control interface 50 and antenna interfaces 59 to 61. Base station controller 55 sends RF signals for transmission via RF feed lines 57 to control interface 50. Auxiliary equipment controller 51 sends commands for controlling controllable antenna elements to control interface 50 which superposes control commands onto RF feed lines 56 to 58. Each antenna includes an antenna interface 59 to 61 which extracts the superposed control commands and provides these to controller actuators 62 to 64 which control actuators 65 to 67 of antennas 68 to 70. It will be appreciated that any number of actuators may be controlled and that these may include control motors to adjust the physical position of an antenna, actuators to adjust phase shifters, actuators to adjust power dividers or other adjustable elements. The control data will include an address for an actuator controller along with control data designating the attribute to be controlled (e.g. down tilt) and a desired value. The actuator controllers may also send status and configuration information to antenna interface is 59 to 61 to be conveyed via control interface 50 to auxiliary equipment controller 51. This status arid configuration information may be supplied to a central controller via backhaul link 54.

Figure 6:
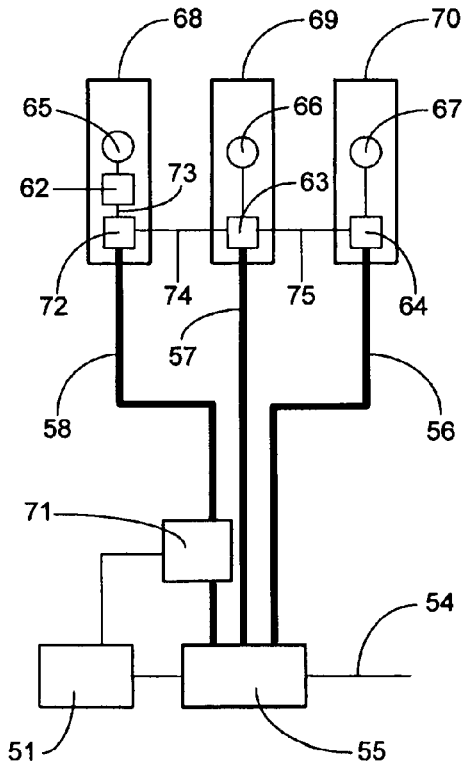
FIG. 6 shows a schematic diagram of a second data communications arrangement for the cellular base station shown in FIG. 4.

FIG. 6 shows a modified version in which like integers and have been given like numbers. In this case the control interface 71 superposes the control data only on RF line 58. An antenna interface 72 is incorporated within antenna 68 and this provides the control data to actuator controllers 62 to 64 via serial cables 73 to 75. This arrangement reduces cost by only requiring a single antenna interface 72 and for control interface 71 to interface only with one feed cable.

Figure 7:
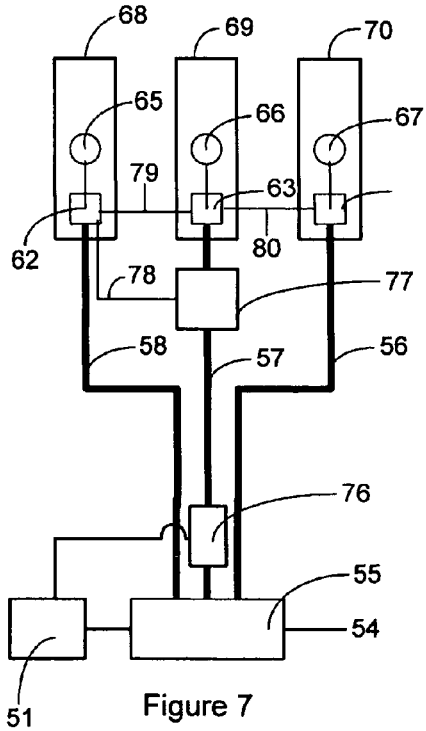
FIG. 7 shows a schematic diagram of a third data communications arrangement for the cellular base station shown in FIG. 4.

FIG. 7 shows an embodiment similar to FIG. 6 except that the antenna interface 77 is located externally to antennas 68 to 70 at the top of a tower. Actuator controllers 62 to 64 are supplied with control data via serial bus connections 78 to 80. This arrangement has the advantage that a standardised antenna unit 68 to 70 may be employed whether control data either is sent up the tower via an RF feed line or a serial cable.

Figure 8:
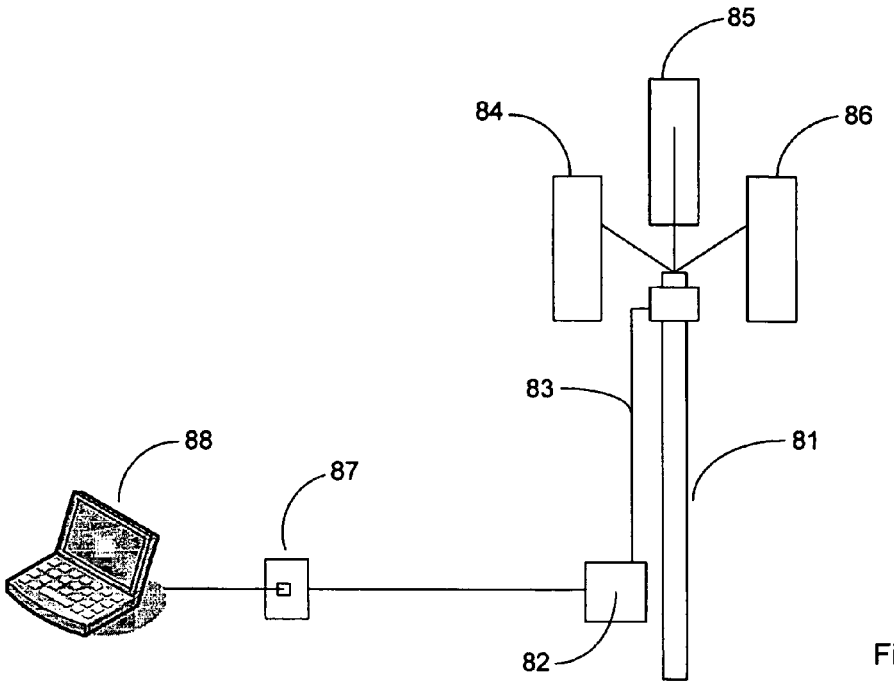
FIG. 8 shows a schematic diagram of a cellular base station in which control data is sent via a serial bus.
Figure 9:
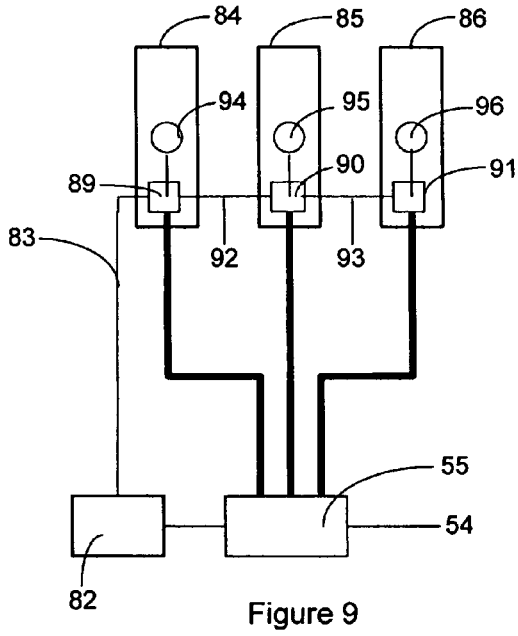
FIG. 9 shows a schematic diagram of a data communications arrangement for the cellular base station shown in FIG. 8.

FIG. 8 shows an embodiment in which control data is sent up tower 81 from auxiliary equipment controller 82 via serial cable 83 to antennas 84 to 86. An access port 87 is provided to enable a portable controller (e.g. a laptop) 88 to communicate directly with auxiliary equipment controller 82 to effect local control. As shown in FIG. 9 actuator controllers 89 to 91 and auxiliary equipment controller 82 are interconnected by serial buses 83, 92 and 93. Actuators 94 to 96 are controlled by actuator controllers 89 to 91 in accordance with control data received from auxiliary equipment controller 82. Status and configuration information from actuator controllers 89 to 91 is communicated via the serial bus to auxiliary equipment controller 82.

Figure 10:
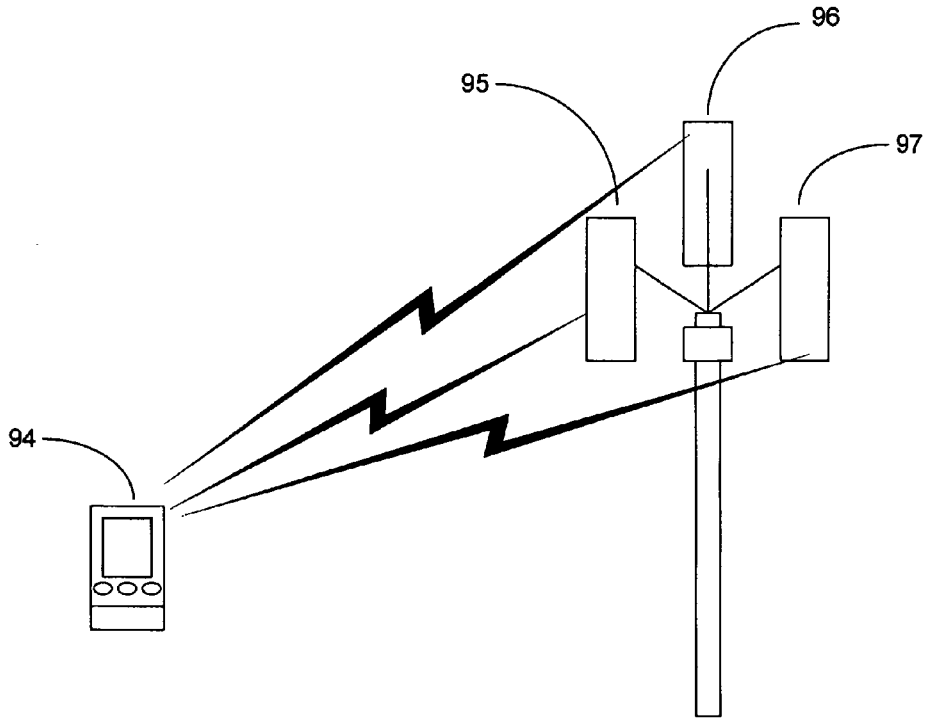
FIG. 10 shows a schematic diagram of a cellular base station in which control data is sent via a wireless link.

FIG. 10 shows a wireless embodiment in which control data is communicated between a controller 94 and antennas 95 to 97 directly via a wireless link. It will be appreciated that controller 94 may be an auxiliary equipment controller at the base station supporting wireless communication or a portable device such as a laptop with a wireless card etc. Controller 94 may also be remotely located and control antennas 95 to 97 via a long-range radio link.

Figure 11:
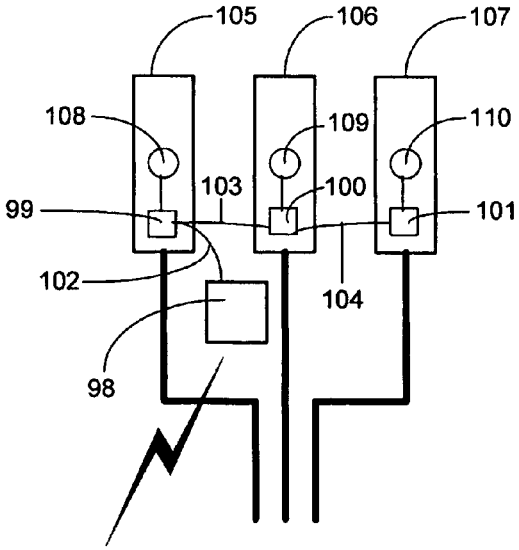
FIG. 11 shows a schematic diagram of a first data communications arrangement for the cellular base station shown in FIG. 10.

FIG. 11 shows a first embodiment in which a single antenna interface 98 communicates wirelessly with a controller 94 and communicates with actuator controllers 99 to 101 via serial bus 102 to 104 to control actuators 108 to 110. This arrangement allows standard antennas 105 to 107 having serial interfaces to be employed.

Figure 12:
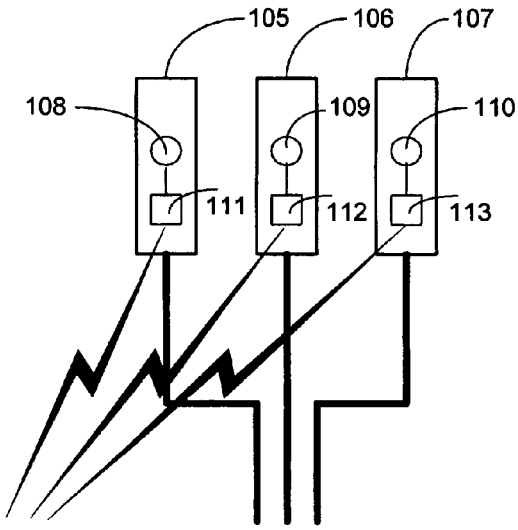
FIG. 12 shows a schematic diagram of a second data communications arrangement for the cellular base station shown in FIG. 10.

FIG. 12 shows an embodiment in which actuator controllers 111 to 113 include wireless communication circuits enabling each actuator controller 111 to 113 to communicate directly with a controller 94.

Figure 13:
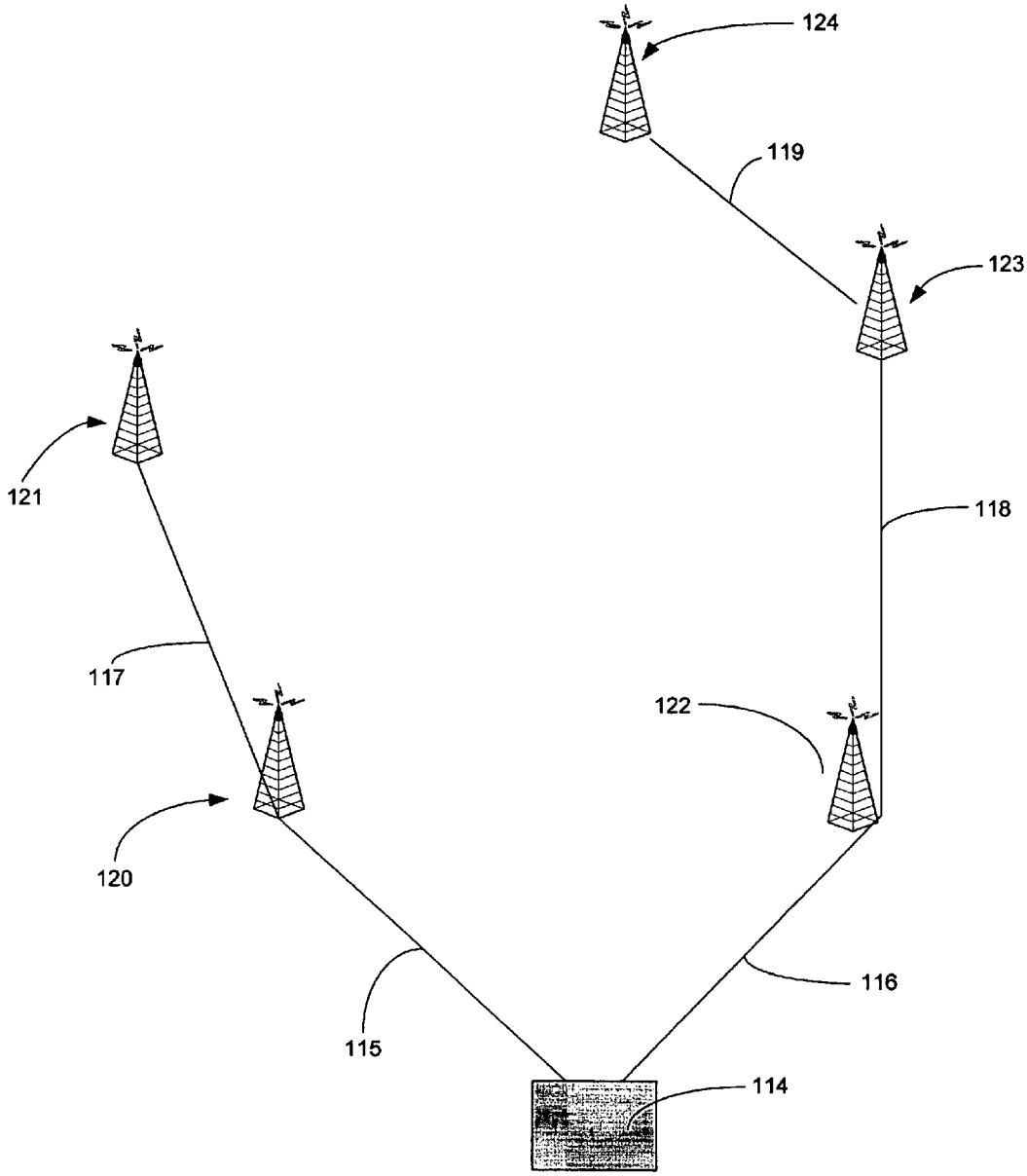
FIG. 13 shows a schematic diagram of a network management system.

FIG. 13 shows schematically a network management system in which a central controller 114 communicates via backhaul links 115 to 119 with a number of base stations 120 to 124. Central controller 114 obtains status and configuration information from each base station controller and sends control data to base stations 120 to 124. Central controller 114 may periodically receive status and configuration information and/or status and configuration information may be sent on request or whenever there is a change. Central controller 114 may adjust antenna attributes according to a schedule, on operator command or actively in response to current operating conditions (e.g. traffic demands etc).

There is thus provided an antenna providing dual electrical azimuth beam steering, combined mechanical and electrical azimuth steering, independent mechanical column steering and dual mechanical steering. This allows beam azimuth to be independently adjusted for two or more arrays. A common controller enables mechanical azimuth, electrical down tilt, electrical beam width and electrical azimuth actuators to be commonly controlled. An addressable serial bus interface simplifies interconnection of antennas and controllers. Control data may be sent via an RF feed line, serial data cable or wireless connection.

While the present invention has been illustrated by the description of the embodiments thereof, and while the embodiments have been described in detail, it is not the intention to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A cellular antenna comprising:

a. a first array of radiating elements configured to develop, when excited, a first beam;

b. a first feed network associated with the first array having one or more first controllable elements for adjusting the azimuth direction of the first beam;

c. a second array of radiating elements configured to develop, when excited, a second beam;

d. a second feed network associated with the second array having one or more second controllable elements for adjusting the azimuth direction of the second beam, wherein the first controllable elements are controlled through a first electrical actuator independently of the second controllable elements to allow independent azimuth steering of the first and second beams of the arrays;

e. an antenna housing accommodating the first and second arrays; and f. an actuator controller configured to receive over an addressable serial bus control data associated with an address assigned to the actuator controller.

2. A cellular antenna as claimed in claim 1 wherein the first array is designed for operation in a first frequency band and the second array is designed for operation in a second frequency band, and wherein the first band is different from the second frequency band.

3. A cellular antenna as claimed in claim 1 wherein the first feed network includes a down tilt phase shifter and a down tilt phase shifter actuator responsive to drive signals from the actuator controller to adjust down tilt of the beam of the first array.

4. A cellular antenna as claimed in claim 1 wherein the first feed network includes a beam width phase shifter and a beam width phase shifter actuator responsive to drive signals from the actuator controller to adjust beam width of the first array.

5. A cellular antenna as claimed in claim 1 wherein the first feed network includes a beam width power divider and a beam width power divider actuator responsive to drive signals from the actuator controller to adjust beam width of the first array.

6. A cellular antenna as claimed in claim 3 wherein the first feed network includes a beam width phase shifter and a beam width phase shifter actuator responsive to drive signals from the actuator controller to adjust beam width of the first array.

7. A cellular antenna as claimed in claim 3 wherein the first feed network includes a beam width power divider and a beam width power divider actuator responsive to drive signals from the actuator controller to adjust beam width of the first array.

8. An antenna as claimed in claim 1, further including an antenna orientation sensor attached to the array antenna, such that the antenna orientation sensor reading is indicative of the azimuth beam direction.

9. An antenna as claimed in claim 8, wherein the antenna orientation sensor sends a compass reading to a controller which controls the controllable elements.

10. An antenna as claimed in claim 9, wherein the controller receives control signals including a signal specifying a desired azimuth beam direction and wherein the controller is configured to control the controllable elements based on the compass reading and the desired azimuth beam direction.

11. An antenna as claimed in claim 10, wherein the controller is configured to correct the compass reading for the offset between magnetic and true north.

12. A cellular antenna as claimed in claim 1 including a mechanical azimuth actuator responsive to control commands to mechanically steer the cellular antenna relative to an antenna support.

13. A cellular antenna as claimed in claim 12 wherein the mechanical azimuth actuator is controlled by a mechanical azimuth actuator controller configured to receive control data over an addressable serial bus associated with an address assigned to the mechanical azimuth actuator controller.

14. A cellular antenna as claimed in claim 1 wherein the controllable elements include active phase adjustment elements.

15. A cellular antenna as claimed in claim 14 wherein the active phase adjustment elements include PIN diodes.

16. A cellular antenna as claimed in claim 14 wherein the active phase adjustment elements are optically controllable.

17. An antenna as claimed in claim 2 wherein the first frequency band is in the range of 824 to 960 GHz and the second frequency band is in the range of 1710 to 1720 GHz.

18. A method of azimuth steering the beams of an integrated cellular antenna having a first array of radiating elements arranged in multiple columns and a second array of radiating elements arranged in multiple columns wherein columns of the first array are fed with phase shifted signals such that the azimuth direction of the beam of the first array is oriented in a first direction and controlled through a first electrical actuator, wherein columns of the second array are fed with phase shifted signals such that the azimuth direction of the beam of the second array is oriented in a second direction, different to the first direction, and wherein an actuator controller is configured to receive over an addressable serial bus control data associated with an address assigned to the actuator controller.

19. A cellular antenna comprising:

a. an array antenna having first and second arrays of radiating elements configured to develop, when excited, first and second beams respectively, the array antenna being rotatably mountable with respect to an antenna support so as to enable mechanical azimuth steering of the first and second beams;

b. a mechanical azimuth actuator configured to rotate the array antenna with respect to an antenna support;

c. a first feed network configured to supply signals to and receive signals from the first array of radiating elements including a first variable element to vary the phase of signals passing through the feed network;

d. a first variable element adjuster configured to adjust the first phase shifter;

e. an actuator controller configured to receive control data and to control the mechanical azimuth actuator in accordance with mechanical azimuth control data received to rotate the array antenna with respect to an antenna support to alter the orientation of the antenna and to control the first variable element adjuster in accordance with electrical azimuth control data received to adjust the azimuth beam direction of the first array with respect to the azimuth beam direction of the second array; and f. a second feed network configured to supply signals to and receive signals from the second array of radiating elements including a second variable element controlled by the actuator controller to vary the phase of signals passing through the second feed network to adjust the azimuth direction of the beam of the second array.

20. A cellular antenna as claimed in claim 19 wherein the first array is configured for operation over a first frequency band and the second array is configured for operation over a second frequency band, different to the first frequency band.

21. A cellular antenna as claimed in claim 20 wherein the second array operates on a lower frequency band.

22. A cellular antenna as claimed in claim 19 wherein the second array is a single column array.

23. A cellular antenna as claimed in claim 19 wherein the first array is an array of cross dipoles.

24. A cellular antenna as claimed in claim 19 wherein the second array is an array of ring radiators.

25. A cellular antenna as claimed in claim 24 wherein the first and second arrays are co-located.

26. A cellular antenna as claimed in claim 19 wherein the actuator controller is configured to receive control data over an addressable serial bus associated with an address assigned to the actuator controller.

27. A cellular antenna as claimed in claim 19 wherein the first phase shifter is an active phase shifter.

28. A cellular antenna as claimed in claim 27 wherein the active phase shifter includes PIN diodes.

29. A cellular antenna as claimed in claim 27 wherein the active phase shifter is optically controllable.

30. An antenna as claimed in claim 20 wherein the first frequency and is in the range of 824 to 960 GHz and the second frequency band is in the range of 1710 to 1720 GHz.

31. A cellular antenna system comprising a central control system and at least two antennas, each of the at least two antennas comprising:

a. an array antenna having first and second arrays of radiating elements configured to develop, when excited, first and second beams respectively, that array antenna being rotatably mountable with respect to an antenna support so as to enable mechanical azimuth steering of the first and second beams;

b. a mechanical azimuth actuator configured to rotate the array antenna with respect to an antenna support;

c. a first feed network configured to supply signals to and receive signals from the first array of radiating elements including a first variable element to vary the phase of signals passing though the feed network;

d. a first variable element adjuster configured to adjust the first phase shifter; and e. an actuator controller configured to receive control data and to control the mechanical azimuth actuator in accordance with mechanical azimuth control data received to rotate the array antenna with respect to an antenna support to alter the orientation of the antenna and to control the first variable element adjuster in accordance with electrical azimuth control data received to adjust the azimuth beam direction of the first array with respect to the azimuth beam direction of the second array, wherein the actuator controllers of the at least two antennas are configured to receive control signals from a central control system to control the beam orientations of the antennas.

32. An antenna system as claimed in claim 31, wherein each antenna includes an electronic compass which provides a compass reading indicative of antenna azimuth orientation to the central control system.

33. An antenna system as claimed in claim 32 wherein the central control system is configured to send control signals to an actuator controller of an antenna to control of an azimuth actuator to bring the compass reading into agreement with a desired azimuth beam direction.

34. A cellular antenna comprising an antenna housing; a plurality of panels of radiating elements located in the antenna housing capable of being independently rotated with respect to the antenna housing, azimuth actuators for independently rotating each panel with respect to the antenna housing, and an antenna housing actuator for rotating the antenna housing with respect to an antenna support.

35. A cellular antenna as claimed in claim 34 wherein each column has a single column of radiating elements.

36. A cellular antenna as claimed in claim 34 wherein each panel is independently rotated to a desired azimuth orientation.

37. A cellular antenna comprising:

a. a central panel having a first array of radiating elements;

b. a first outer panel having a second array of radiating elements, the first outer panel rotatably connected to a first edge of the central panel;

c. a second outer panel having a third array of radiating elements, the second outer panel rotatably connected to a second edge of the central panel; and d. an actuator arrangement for rotatably adjusting both of the relative positions of the first and second outer panels with respect to the central panel.

* * * * *